US005289863A

United States Patent [19]

Schön

[11] Patent Number: 5,289,863

[45] Date of Patent: Mar. 1, 1994

[54] APPARATUS FOR SUSPENDING LAMELLAR SUN-BLINDS OR THE LIKE

[75] Inventor: Siegfried Joachim Schön, Meer, Belgium

[73] Assignee: Schon B.V., Breda, Netherlands

[21] Appl. No.: 995,539

[22] Filed: Dec. 22, 1992

Related U.S. Application Data

[63] Continuation of Ser. No. 768,922, Oct. 9, 1991, abandoned.

[30] Foreign Application Priority Data

Dec. 13, 1989 [NL] Netherlands ..... 8903061

[51] Int. Cl.[5] ..... E06B 9/36

[52] U.S. Cl. ..... 160/168.1; 160/178.1; 160/900

[58] Field of Search ..... 160/168.1, 176.1, 178.1, 160/900, 166.1

[56] References Cited

U.S. PATENT DOCUMENTS

| | | | |
|---|---|---|---|
| 3,343,588 | 9/1969 | Cayton | 160/176.1 |
| 4,350,197 | 9/1982 | Haller | 160/176.1 X |
| 4,616,688 | 10/1986 | Agos | 160/176.1 |
| 4,732,202 | 3/1988 | Anderson | 160/168.1 |
| 4,759,397 | 7/1988 | Walther | 160/176.1 X |
| 4,848,435 | 7/1989 | Helver | 160/900 X |

*Primary Examiner*—Blair M. Johnson

*Attorney, Agent, or Firm*—Jacobson, Price, Holman & Stern

[57] ABSTRACT

An apparatus for suspending lamellar sun-blinds or the like, which apparatus comprises a profile open on at least one side with guiding, wherein a number of carriers (5) each having a gear transmission (8) and movable along the guiding by means of a control means, a control rod (11) arranged rotatably in and parallel to the profile, which is carried in each case through one of the gears of the transmission (8), a vertical rotating pin (7) with depending member for the slat connected to another gear and supported by the carrier, a spacer strip (66) connected to each of the carriers (5) which is guided slidably in a guiding of the adjacent carrier, wherein the spacer strip (66) is fixed on the side of the carrier such that the blade of the strip is vertically oriented in order to provide a profile dimensioning that is aesthetically well-considered, requires small dimensions particularly in the height and is thereby easy to combine with other profiles for additional applications.

12 Claims, 3 Drawing Sheets

FIG. 2
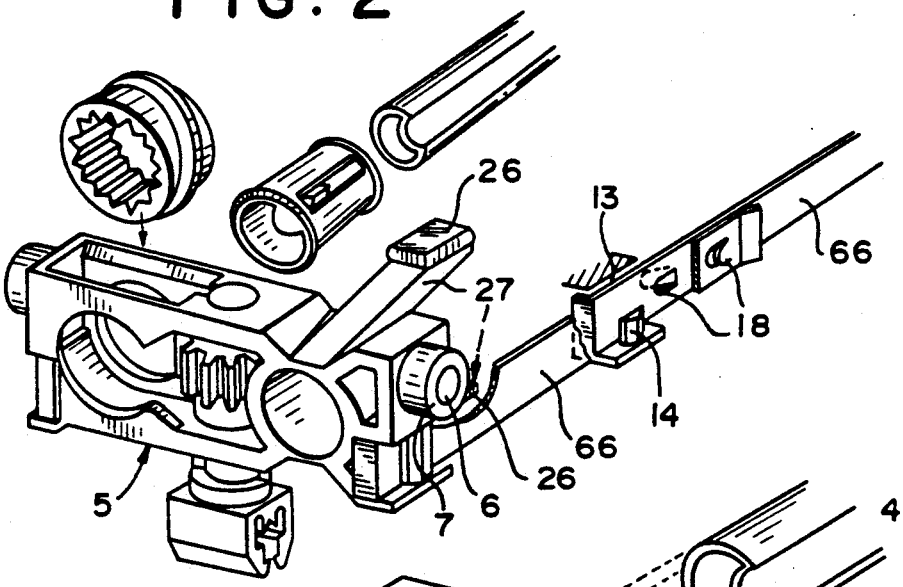
FIG. 3
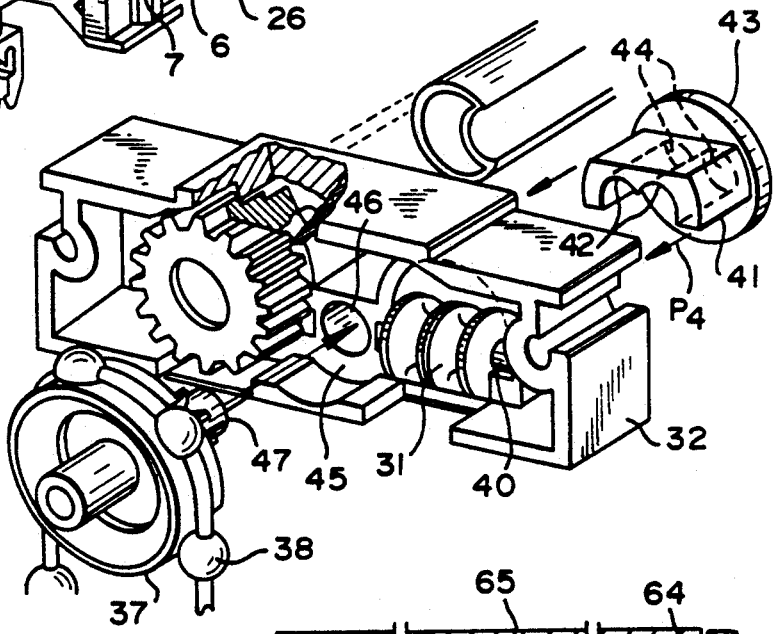
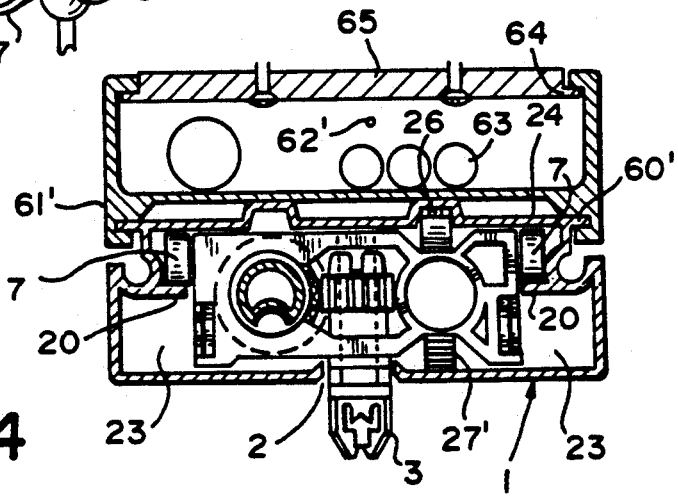
FIG. 4

FIG. 5
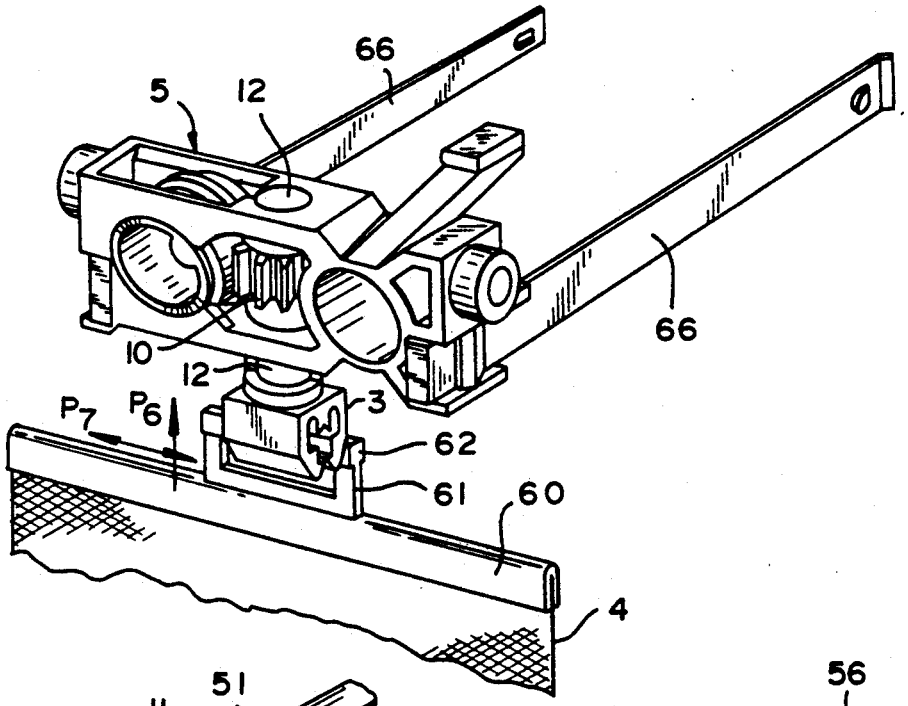
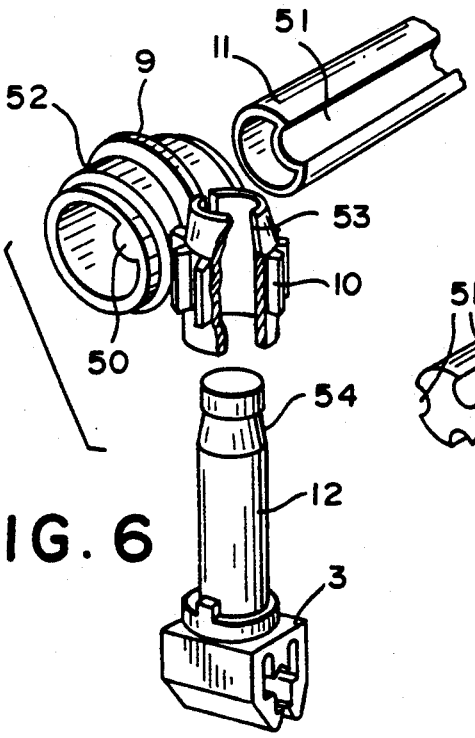
FIG. 6
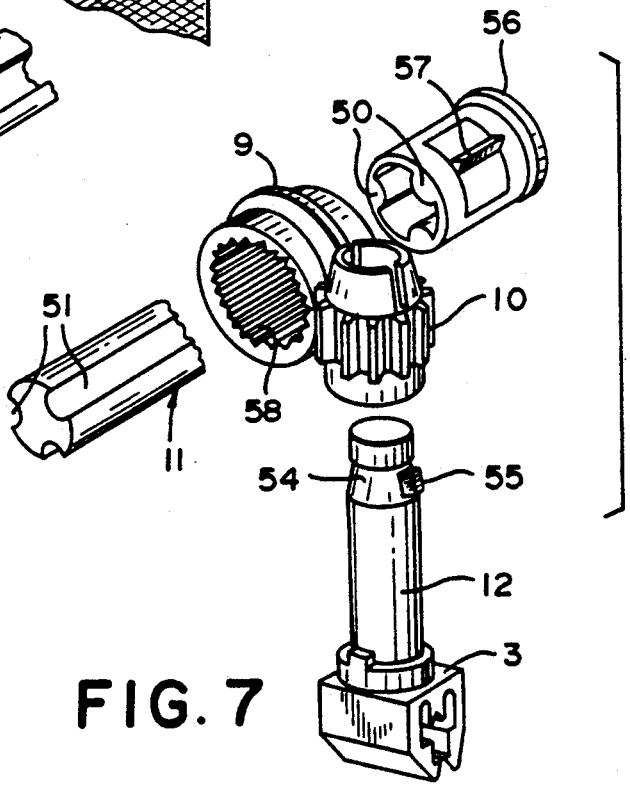
FIG. 7

APPARATUS FOR SUSPENDING LAMELLAR SUN-BLINDS OR THE LIKE

This application is a continuation of application Ser. No. 07/768,922, filed Oct. 9, 1991, now abandoned.

FIELD OF THE INVENTION

The invention relates to an apparatus for suspending lamellar sun-blinds or the like, which apparatus comprises a track profile open on at least one side with guideway, a number of carriers each having a gear transmission and movable along the guideway by means of a control means, a control rod arranged rotatably in and parallel to the track, which is carried in each case through one of the gears of the transmission, a vertical rotating pin with a depending member for a slat connected to another gear and supported by the carrier, a spacer strip connected to each of the carriers and guided slidably in a guiding of the adjacent carrier.

BACKGROUND OF THE INVENTION

Such an apparatus of the type described in the preamble is often used for closing off openings, for example window openings, to which end the slats are disposed regularly over the surface of the opening and brought into a more or less overlapping position by being rotated about a vertical axis. The disposing movement and the rotating movement can be performed independently of one another.

The slats are automatically disposed over the surface of the opening by placing one carrier at an interval from another carrier, this interval being determined by a stop on the spacer strip. As the carrier moves further each following carrier is taken along with it, this movement again being defined by the following spacer strip. The drawback to the known apparatus is that the track in which the carriers are guided is relatively high, which does not improve the appearance of the whole curtain. The series of spacer strips stacked onto each other in any case requires a particular thickness, the dimension of which is added to the height of the carrier.

SUMMARY OF THE INVENTION

The invention has for its object to obviate the above stated drawback and to provide a track size which is aesthetically pleasing, requires small dimensions and is therefore easy to combine with other tracks for additional applications.

The apparatus according to the invention is distinguished in that the spacer strip is fixed to the side of the carrier such that the blade of the strip is vertically oriented.

Owing to the vertical placing of the blade of the strip, the series of spacer strips pushed onto each other is no longer formed in the height, but in the breadth, wherein thinner strips can be used because of the more favourable self-supporting effect of the vertical position of the spacer strips, which likewise reduces the thickness of the series of strips. The advantage of the standing vertical strip is moreover that the guiding rail of the lamellar sun-blind can be arranged at an angle diverging from the horizontal, wherein the carriers are nonetheless held in the correct position by the spacer strips without breakage occurring.

It is recommended to provide a track shaped as a rectangular tube with a continuous, inward pointing ridge on each side wall between the top and bottom wall in order to provide on the one side a chamber formed with the top or bottom wall for receiving the standing spacer strips and on the other side a guideway for the carriers.

In this latter case the distance between the ridge and the top or bottom wall is at least equal to the diameter of a travel wheel arranged on the carrier.

The total height of the track virtually corresponds therein with the height of the carrier, so that the track can practically enclose the carrier in close-fitting manner.

In the preferred embodiment, a guideway is arranged in the top wall of the profile to receive the end of an arm fixed to the carrier. This arm likewise serves to maintain the correct position of the carrier in the profile, whereby this does not become jammed, even in the case of an uneven load on the slat for instance. According to a further development of the invention, the track is provided with a recessed wall adjacent to the carrier guideway, whereby space is formed for arranging additional tracks. The depth measurement of the additional track need not therein exceed that of the guideway rail profile.

Above stated and other characteristics of the invention will be further elucidated in the figure description hereinbelow of a number of embodiments which are shown in the annexed drawings. In the drawing:

BRIEF DESCRIPTION OF THE FIGURES

FIG. 2 shows a perspective view of a detail of the apparatus, namely the carrier and components co-acting therewith from FIG. 1, FIG. 3 shows a perspective view corresponding with FIG. 2 of another detail of the apparatus from FIG. 1, FIG. 4 shows a section of the apparatus of FIG. 1 provided with an additional track, FIG. 5 shows a view corresponding with FIG. 2 of an alternative embodiment of the carrier, FIGS. 6 and 7 each show a perspective view of a possible gear transmission embodiment in the carrier provided with an overrun clutch.

DETAILED DESCRIPTION OF THE PREFERRED EMBODIMENTS

Figure 1:
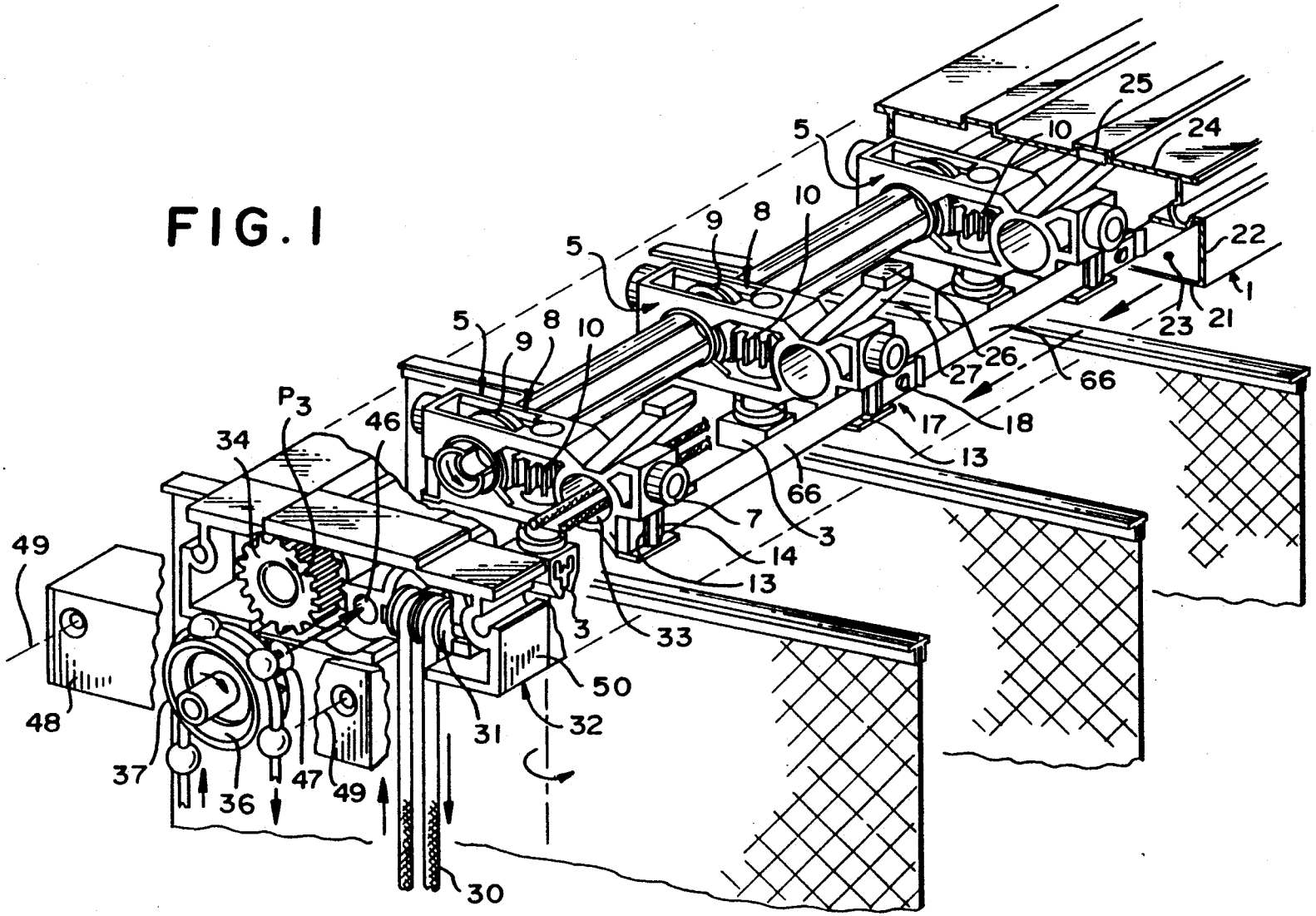
FIG. 1 shows a perspective top view of a sun-blind according to the invention, wherein parts of the guiding track are broken away for the sake of clarity.

The apparatus shown in FIG. 1 consists of a hollow track 1, which is preferably tubular and has a longitudinal slit 2 in the bottom wall, through which the depending members 3 of each slat 4 can move. The track 1 is fixed to the ceiling or other fixed construction part in a manner not shown further but such that the continuous groove 2 lies on the underside of the track.

Carriers 5 are received in the track, wherein each carrier is provided on either side with a travel wheel 7. This travel wheel is freely rotatable around a fixed pin 6 on the carrier 5. The carrier 5 with pin 6 is preferably formed as a single moulding of suitable material, for instance plastic.

Arranged in the carrier is a gear transmission 8 consisting of a worm gear 9 and a pinion 10. The worm gear 9 has a central opening, through which is carried a control rod 11 extending parallel to the track. The control rod 11 is non-round, this such that when the rod 11 is turned the worm gear 9 can rotate therewith. The worm gear 9 therein sets the pinion 10 in rotation. A spindle 12 of the depending member 3 is inserted into the hollow core of the pinion 10.

Each carrier 5 is subsequently provided with a spacer 66 which is embodied as a strip of suitable material, and which according to the invention is mounted fixedly with one end in a recess 13 in the side of the carrier 5. The recess is further provided with a standing strip 14 at an interval from the bottom of the recess 13, this such that not only can the one end of the strip 66 be carried into the space between element 14 and the bottom of recess 13 but also the other end of the strip 66 of an adjacent carrier, see at 17 in FIG. 1. The other end of the strip 66 is provided with a stop 18, which prevents the other end being pulled out between the recess 13 of the adjacent carrier.

According to a characteristic of the invention the track 1 is provided on the inside with a rib 20 oriented parallel to the top and bottom wall, which forms with the bottom wall 21 and the side wall 22 a chamber 23 extending to the side of the travel path of the carriers 5. This chamber 23 serves to receive the strips 66 pushed on top of each other when the carriers are pulled against each other. The rib 20 also serves to support the travel wheels 7 of the carriers 5 since with the top wall 24 of the track 1 this rib 20 forms a rail-like guiding, see also FIG. 4.

Also arranged in the top wall 24 are outward protruding grooves 25 in which the end 26 of an arm 27 can slide. This arm 27 serves to prevent the carriers 5 from tilting and going out of square in the track 1 and thus to facilitate the sliding of the carriers 5 along the rod 11 and the sliding of the strip 66 in the recess 13. If necessary, an arm 27' with a similar function can likewise be arranged on the underside of the carrier 5, see FIG. 4.

The carriers 5 can slide in the track 1 in the direction of the arrow P1 by means of a control member in the form of a pull cord 30. Shown at bottom left in FIG. 1 are two parts of the pull cord 30 which is guided around a reversing wheel at the end (not shown) of track 1. A part of the pull cord 30 is fixed to the last carrier in the row, which is likewise not shown. The last carrier is therefore moved reciprocally by the pull cords 30, which last carrier pulls the following carrier along with it by means of the strips 66 each time the maximum distance between the carriers is reached. When the cord 30 is pulled in the opposite direction the last carrier will push the preceding carriers onward until they lie against each other.

The pull cord 30 can be trained through the track 1 in a head end element 32 via guide wheels 31, wherein the cords move through an opening 33 of each carrier 5.

The head end element 32 is also an end bearing for the rod 11, in which bearing the rod 11 is received for free rotation. The end of the rod 11 protruding outside the bearing is provided with a gear wheel 34 which is in engagement with a pinion 35 of a drive wheel 36. The drive wheel 36 is provided with a peripheral ring 37 with recesses for receiving a ball chain 38 which, when one of the parts of the chain 38 is pulled, causes the ring wheel 37 to turn in the direction of the arrow P2 whereby the gear wheel 34 is also set into rotation according to arrow P3 via the gear wheel 35. The gear wheel 34 carries the rod 11 with it and therewith all the worm gears 9 in each carrier 5.

The head end element 32 is embodied like the carriers as a single injection moulding in which the various components are mounted for free rotation. The guide wheel 31 for the cord 30 is for instance provided at either end with a stub 40 which is received in a recess 42 of a wall of the head end element molding 32. The cord guiding is ensured by a cap-like insert piece 41 with arcuate recess 42 which can be pushed into the injection molded piece 32 according to arrow P4. A circular rear wall 43 of the insert piece 41 is provided with through-holes 44 for passage of the cord parts 30.

Recessed into a bridge piece 45 of the injection moulding 32 is an opening 46 for receiving a shaft stub 47 of the ring wheel 37. The other end of the shaft stub 47 is received rotatably in a head end cover 48 which can be connected to the injection moulded piece 32 by means of screws 49 via a side wall 50 of the injection moulding 32 formed in alignment with the track 1. In this way the entire mounting of the cord drive system and the rotation setting system of the slats 4 is achieved with only two screws 49 on either side of the head end cover 48.

FIG. 5 shows an embodiment of the carrier 5 wherein a vertical standing spacer strip 66 is arranged on either side of the carrier. The spacer strips can be received in a like chamber 23 on the other side of the profile 1, see FIG. 4, such that hardly any increase in the dimensions of the track 1 is necessary.

The spindle 12, which is carried through the pinion 10, carries as one piece on its underside a depending member 3 which has a pincer-shaped form. The two oppositely located parts of the pincer are somewhat flexible relative to one another because of the use of plastic, so that a slat strip 60 arranged on the slat and provided with a suspension bracket 61 can be placed through the slit between the pincer parts 3 in the direction of the arrow P6. The bracket 61 therein has a thickened upper portion 62, which prevents the slat being pulled out of the pincer-shaped depending member 3 unexpectedly. If the slat needs to be replaced, then the bracket 62 only needs to be pushed out of the pincer-shaped depending member 3 in the direction of the arrow P7.

There now follows a description, with reference to FIGS. 6 and 7 of two different embodiments of a friction clutch between the transmission and the rod 11 on the one hand and the spindle 12 of the depending member 3 on the other.

In the embodiment according to FIG. 6 the central opening of the worm gear 9 is embodied with a longitudinal key 50 which fits into the longitudinal groove 51 of the rod 11. This makes possible sliding of the worm gear 9 and therefore sliding of the carriers 5 relative to the rod 11 but when the rod 11 is rotated the worm gear 9 can also be rotated. When the worm gear 9 which has one screw thread 52 is rotated, the pinion 10 which is received in the carrier 5 for free rotation will be rotated. By passing the spindle 12 through the central opening of the pinion 10 the top end of the spindle comes to lie beyond the top end of the pinion 10, which fits in the bearing-like opening of the carrier 5. In this way the pinion 10 is automatically bearing mounted in the carrier 5. The pinion 10 is embodied on the top side with inward pointing flanges 53 which rest resiliently against a slanting surface 54 of the spindle 12. This resilient action ensures a friction between the spindle 12 and the pinion 10, so that when the spindle 12 becomes jammed as a result of an obstruction on the slat 4 the rod 11 can still be rotated further since the pinion 10 can be rotated freely relative to the spindle 12.

In the embodiment according to FIG. 7 the spindle 12 is embodied in similar manner with a slanting surface 54 which co-acts with the fraction flanges 53 of pinion 10. The spindle 12 is further provided with a protrusion 55 which falls into the slit between the flanges 53 of pinion 10, thus effecting a non-rotatable connection between spindle 12 and pinion 10.

The rod 11 is provided here with three grooves 51' which co-act with the ridges 50' of a friction sleeve 56. This friction sleeve is embodied with an outward protruding resilient ridge 57 which co-acts with an axial toothing 58 on the inner wall of the central opening of the worm gear 9. In this embodiment, when the rod 11 is rotated a rotation of the rod 11 relative to the worm gear 9 is possible, wherein the ridge 57 will fall into the following recess between the toothings 58. A friction clutch is therefore also obtained here which enables a relative movement between the rotation of the rod 11 and of the spindle 12.

In both embodiments the thickened head of the spindle 12 lies against the end edge of the flanges 53 in order to be able to lock the spindle 12 in the pinion 10 in axial direction. This is the second function of the flanges 53. The spindle can herein be removed from the pinion without having to slide the carriers out of the guiding.

Finally, it is pointed out that the track 1 is embodied at the top surface 24 with outward protruding flange edges 60' which can serve for arranging additional profiles 61'. These additional profiles 61 can be embodied hollow with forms of a continuous chamber 62' in which lines of a random nature can be accommodated. The track 61' can be fixed to a ceiling strip 65 with a snap connection at 64. This greatly facilitates assembly. Other assembly systems for arranging the track 1 on the ceiling can of course be applied.

The invention is not limited to the above described embodiment.

I claim:

1. Apparatus for suspending lamellar sun-blinds or the like, which apparatus comprises:

a rail having a rectangular profile, comprising a top wall, two opposing side walls and a bottom wall provided with a longitudinal slit, said rail further comprising means defining a guideway, said guideway defining means extending longitudinally along one of said side walls and extending toward the opposing sidewall such that a chamber is formed between said guideway defining means, said bottom wall and said one of said side walls;

a number of carriers each having a gear transmission, said carriers being movable along the rail by means of a control means;

a rotatable control rod arranged in and parallel to the rail, said control rod extending through a gear member of the transmission of each carrier;

a vertically rotatable spindle supported by each of the carriers and connected to another member of said gear transmission, each said spindle comprising a depending member for receiving said lamellar sun-blind or the like; and a spacer connected to each of the carriers, wherein each of said spacers is fixed to the side of a respective one of the carriers and the spacers are received in the chamber of the rail when the carriers are pulled against each other.

2. Apparatus as claimed in claim 1, wherein the chamber extends longitudinally below and transversely beyond the guideway towards said one of said side walls of the rail.

3. Apparatus as claimed in claim 2, wherein the spacers are in the form of vertically oriented strips, which are guided slidably in a recess of the carrier.

4. Apparatus as claimed in claim 3, wherein the guideway defining means is in the form of an inwardly directed rib on each side wall between the bottom wall and the top wall to form below it the chamber to receive the vertically oriented spacer strips and above it a guiding surface for the carriers.

5. Apparatus as claimed in claim 4, further comprising a pair of wheels, the wheels of each pair being rotatably mounted on opposite sides of each of the carriers.

6. Apparatus as claimed in claim 5, wherein the distance between the rib and the top wall is only slightly in excess of the diameter of the carrier wheel and wherein the distance between the rib and the bottom wall is only slightly in excess of the vertical heights of the spacer strips.

7. Apparatus as claimed in claim 1, wherein a groove is arranged in the top wall for receiving an end of an arm attached to the carrier.

8. Apparatus as claimed in claim 1, wherein the spacers are arranged on both sides of the carriers.

9. Apparatus as claimed in claim 1, wherein the gear transmission includes a worm gear and a pinion cooperating therewith and wherein a friction clutch is interposed between the worm gear and the control rod.

10. Apparatus as claimed in claim 1, wherein the gear transmission includes a worm gear and a pinion cooperating therewith and wherein a friction clutch is interposed between the pinion and the spindle.

11. Apparatus as claimed in claim 1, wherein the control means comprises a pull cord extending alongside the control rod through openings in the carriers and wherein a head end element is provided on at lease one longitudinal end of the rail, said head end element comprising a pair of side-by-side openings, one of said openings forming a bearing for the control rod while the other of said openings receives a cord guiding insert for guiding said pull cord.

12. Apparatus as claimed in claim 1, wherein the height and breadth dimensions inside of the rail are each slightly greater than, but closely corresponding to those of the carriers movable therein.

* * * * *